United States Patent [19]

Brunel

[11] Patent Number: 4,889,096

[45] Date of Patent: Dec. 26, 1989

[54] FUEL INJECTION PUMP FOR INTERNAL COMBUSTION ENGINES

[75] Inventor: Andre Brunel, St. Genis Laval, France

[73] Assignee: Robert Bosch GmbH, Stuttgart, Fed. Rep. of Germany

[21] Appl. No.: 333,054

[22] Filed: Apr. 4, 1989

[30] Foreign Application Priority Data

May 14, 1988 [DE] Fed. Rep. of Germany ..... 3816508

[51] Int. Cl.[4] ..... F02M 39/00

[52] U.S. Cl. ..... 123/450; 417/462

[58] Field of Search ..... 123/450, 451, 495; 417/462, 460

[56] References Cited

U.S. PATENT DOCUMENTS

| | | | |
|---|---|---|---|
| 3,267,861 | 8/1966 | Pigeroulet | 417/462 |
| 4,083,345 | 4/1978 | Davis | 123/450 |
| 4,173,959 | 11/1979 | Sosnowski | 417/462 |
| 4,348,163 | 9/1982 | Gilbert | 417/462 |
| 4,486,154 | 12/1984 | Duplat | 417/462 |
| 4,552,117 | 11/1985 | Djordjevic | 123/450 |
| 4,652,220 | 3/1987 | Mowbray | 123/450 |

FOREIGN PATENT DOCUMENTS

| | | | |
|---|---|---|---|
| 3424881 | 2/1986 | Fed. Rep. of Germany | 123/450 |

*Primary Examiner*—Carl Stuart Miller

*Attorney, Agent, or Firm*—Edwin E. Greigg

[57] ABSTRACT

A fuel injection pump formed as a radial piston pump having an encompassing cam ring, which drives pump pistons and a feed piston, which feed piston is embodied as a feed pump and is urged by a spring in the direction of the cam race. This arrangement results in a small size for the pump, in which sealing problems are substantially reduced and only a small idle fuel volume must be moved. By means of this fuel injection pump, a relatively high fill pressure in a pump work chamber is attained.

9 Claims, 1 Drawing Sheet

FUEL INJECTION PUMP FOR INTERNAL COMBUSTION ENGINES

BACKGROUND OF THE INVENTION

The invention is based on a fuel injection pump as defined herein. In a fuel injection pump of this type, known from German Offenlegungsschrift No. 30 11 831, a pump work chamber is supplied by control grooves disposed on the circumference of a distributor. The control grooves can be made to communicate with a supply conduit, which communicates both with a reservoir chamber having a reservoir piston on the one hand and with a feed pump, attached to the outside of the fuel injection pump.

Such a fuel injection pump has the disadvantage that it requires an inflow line from the feed pump to the fuel injection pump, which presents additional sealing problems and necessitates a supply conduit. The result is a very large-sized fuel injection pump, and a larger volume of fuel must be moved during fuel pumping.

OBJECT AND SUMMARY OF THE INVENTION

The fuel injection pump according to the invention has an advantage over the prior art that a feed piston, embodied as a feed pump, is driven simultaneously with the pump piston by means of a cam race of a fuel injection pump. This makes it possible to produce a fuel injection pump that is smaller and shorter. Only a small volume of fuel at filling pressure is required. Sealing at the connecting points, bearings and shafts can be accomplished simply and entails no additional expense.

In a particularly advantageous feature of the invention, the idle volume is smaller because short connections at increased feed pressure are provided. Another advantageous feature is the cooperation of the control grooves, annular groove, return line and relief line.

The invention will be better understood and further objects and advantages thereof will become more apparent from the ensuing detailed description of a preferred embodiment taken in conjunction with the drawings.

DESCRIPTION OF THE PREFERRED EXEMPLARY EMBODIMENT

Figure 1:
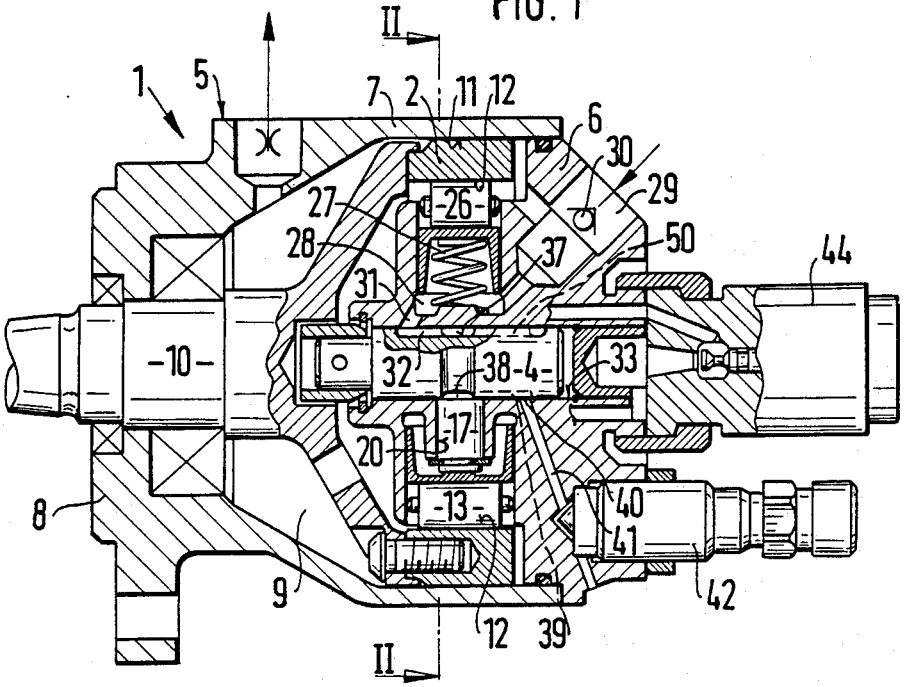
FIG. 1 shows a first exemplary embodiment of the fuel injection pump according to the invention, in a longitudinal section.
Figure 2:
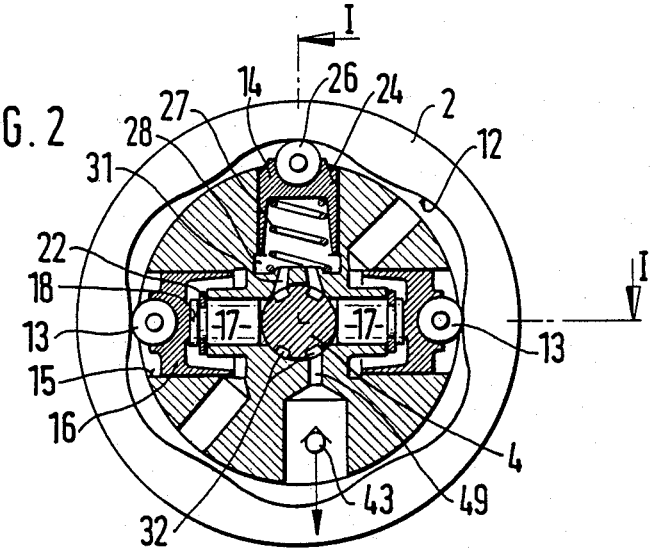
FIG. 2 is a section taken crosswise to the longitudinal axis of the fuel injection pump.

The fuel injection pump shown in longitudinal section in FIG. 1, for supplying an internal combustion engine, not shown, has a pump housing 1. The pump housing 1 comprises a cylindrical cup-shaped housing part 5 and a cylindrical cap part 6 closing off the cup-shaped housing part 5. The housing part 5 has a cylindrical housing portion 7 and a bottom part 8, and the cap part 6 is inserted from the open end of the cylindrical portion 7, to attain a sealed enclosure of a pump chamber 9. One end of a drive shaft 10 protrudes coaxially through the bottom part 8 and the opposite inner end enlarges in cup-like fashion in the pump chamber 9 of the fuel injection pump and is joined at the edges to a cam ring 2, the jacket face of which is guided on the cylindrical wall 11 of the cylindrical housing portion 7. The cam ring 2 has a cam race 12 on its inside surface, with radially inwardly oriented cams, which are adapted in number and order to the number and order of pump pistons 17 that are provided in the fuel injection pump.

The cam race 12 disposed in the cup-shaped housing part 5 cooperates with a feed piston 14 and two pump pistons 17; these pistons 17 are located in the same radial plane, are oriented radially with respect to the axis of the cap part 6 and the axis of the drive shaft 10, and are guided in the cap part 6. To this end, the cap part 6 has radially oriented pump piston guide cylinders 20, which discharge at one end in a distributor cylinder 33, which is disposed in the cap part 6 coaxially with the drive shaft 10, and on the other end discharge via cylinder-liner-like fittings into bores 15 of larger diameter that adjoin the cam race; cup-shaped roller tappets 16 are guided in these bores 15. The roller tappets 16 have recesses, toward the cam race, for rollers 13, which in following the cam race 12 serve to drive the roller tappets 16, and with their inner bottom face 18 serve to support the pump pistons 17. The inward stroke of the pump pistons 17 toward the distributor cylinder 33 is limited by securing rings 22 which are inserted on the pump piston circumference and come to rest against the fittings. Toward the distributor cylinder side, the pump pistons 17 define a pump work chamber 38, which is defined on the other side by an annular groove 37 in the jacket face of a distributor 4 guided in the distributor cylinder 33 and coupled to the drive shaft 10 in an rpm-synchronized manner.

Also disposed in the cap part 6 is a guide cylinder 24, which is radially oriented with respect to the axis of the drive shaft 10 and offset by 90° to one of the pump pistons 17. The feed piston 14 slides in this guide cylinder 24 and also has a seat, toward the cam race, for a roller 26, which follows the cam race 12 and serves to drive the feed piston 14. On the side opposite the roller 26, that is, on the inside of the feed piston 14, is a compression spring 27, which is supported on an inward portion of the cap part 6. This compression spring presses the roller 26 against the cam ring 2. The stroke of the feed piston 14, in the guide cylinder 24 embodied as a blind bore, is designed such that a pump interior 28 still remains inside the blind bore. Leading into this pump interior 28 is a fuel inflow line 29; a control valve 30, such as a check valve or a slide valve controlled synchronously with the drive shaft 10, is disposed in the line 29 in the pump housing 1. This fuel inflow line 29 and the control valve 30 enable fuel to be drawn into the pump interior 28 during the intake stroke of the feed piston 14. During the inward motion of the feed piston 14, the control valve 30 is closed, and fuel is forced via two filling bores 31, discharging into the distributor cylinder 33, into each of a plurality of control grooves 32 (in the present case, six) disposed parallel to the axis of the distributor 4 in the jacket face of the distributor 4. The control grooves 32 communicate continuously with the annular groove 37.

During the compression stroke of the feed piston 14, the annular groove 37 is subjected to the pressure generated by the feed piston 14. To avoid damage to the feed piston 14, distributor 4 or control grooves 32, this pressure must be limited to a predetermined maximum allowable pressure; accordingly, during the compression stroke of the feed piston 14, there is communication via one of the control grooves 32 with a return line 49 leading away from the distributor cylinder 33. The return line 49 is disposed in the cap part 6, and a pressure limiting valve 43 disposed in the return line opens beyond a predetermined pressure in the annular groove 37. Because the feeding is always under limited pressure, the pump pistons 17 always follow the cam race 12 during the intake stroke, even without the provision of separate restoring springs, and upon each working stroke the pump work chamber 38 fills completely with fuel.

A relief conduit 50 also leads away from the annular groove 37 and includes a valve 44 controlled as a function of operating parameters of the engine. The closing state of this preferably electrically controlled valve 44 determines the injection time, and upon opening of the valve 44 the fuel not required for injection is carried away.

A conduit 39 disposed in the distributor 4 also leads away from the annular groove 37, in this case to a distributor opening 40, through which a plurality of pressure conduits 41, disposed in the cap part 6 of the fuel injection pump, are triggered in alternation upon rotation of the distributor 4 and for the duration of the pump piston feed stroke. In the exemplary embodiment, both the conduit 39 and the distributor opening 40 are embodied by a longitudinal groove originating at the annular groove 37.

The pressure conduits 41 are disposed, in accordance with the number and order of cylinders of the fuel injection pump that are to be supplied, along the circumference of the distributor 4 or distributor cylinder 33 such that whenever communication is established between the distributor opening 40 and one of the pressure conduits 41, the communication between the control grooves 32, the fill bores 31 and the return line 49 is interrupted. The pressure conduits 41 lead for instance via a pressure valve 42 to connections on the face end for injection lines, which communicate with injection nozzles.

The apparatus according to the invention functions as follows:

If the drive shaft 10 is driven, then the cam ring 2 is driven synchronously with the distributor 4 and set into rotation, so that both the rollers 26 and 13 run on the cam race 12. The rotation of the cam race 12 and cam ring 2 generates a reciprocating motion of the feed piston 14 and both pump pistons 17 that are 90° away from the feed piston. During the pump piston intake stroke, in which the cam race 12 allows the pump pistons 17 to move outward, the feed piston 14 is simultaneously moved inward, and forces fuel out of the pump interior 28 into the annular groove 37 via the fill bores 31, described in further detail above, and via the control grooves 32.

The feed pressure is increased to a pressure that is determined by the pressure limiting valve 43. This pressure suffices to restore the pump pistons 17 to bottom dead center again after the compression strokes. From bottom dead center, the pump pistons 17, cooperating with the rotating cam race 12, are moved toward top dead center toward the distributor 4, with the fill bores 31 having meanwhile been closed. As a result, the fuel is compressed and carried via the conduit 39 and one of the pressure conduits 41 and the pressure valve 42 to an injection valve. The injection time, injection onset and injection duration are determined by the electrically controlled valve 44.

While the pump pistons 17 are moving inward toward the distributor 4, the feed piston 14 moves outward, away from the distributor 4, under the influence of the restoring spring 27, and aspirates fuel from a tank or fuel reservoir via the fuel inflow line 29 and the now-opened control valve 30, so that a new cycle can begin.

Because of the simultaneous drive of the feed piston 14 and the pump pistons 17 by means of the cam race 12, a fuel injection pump of small structural size and short length can be produced, in which the sealing problems are substantially less. Only a small idle fuel volume needs to be moved, and a relatively high fill pressure in the pump work chamber 38 is attained.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a distributor (4) rotating in a distributor cylinder (33) and having at least one pump piston (17) disposed in a pump housing (1) radially relative to the distributor (4) and defining a pump work chamber (38), which pump piston is driven by cams of a cam race (12) of a cam ring (2), following the cam race (12), the pump work chamber (38) is supplied with fuel by a fuel feed pump via a supply conduit controlled by control grooves (32) in the distributor (4), simultaneously with radial movement of the pump piston (17), a feed piston (14) embodied as a feed pump and urged by a spring toward the cam race (12) and likewise disposed radially to the distributor (4) and driven by the cam race (12), said feed piston (14) defining a pump interior (28) in a guide cylinder (24), said pump interior communicating on the one hand, in the intake stroke of the feed piston (14) via a control valve (30), with a fuel inlet line connected with a fuel reservoir, and, on the other with the control valve (30) closed, the pumping stroke of the feed piston (14) communicating with the pump piston (17) via said pump work chamber (38) and can simultaneously be made to communicate with the fuel reservoir, via a pressure limiting valve (43).

2. A fuel injection pump as defined by claim 1, in which communication of the pump interior (28) with the pump work chamber (38) can be established via at least one of a plurality of control grooves (32) which are distributed on the circumference of the distributor (4).

3. A fuel injection pump as defined by claim 2, in which said pump work chamber (38) communicates continuously with an annular groove (37) formed between the distributor (4) and the distributor cylinder (33), into which annular groove the control grooves (32) discharge and from which a relief conduit (50) containing a valve (44) controlled as a function of engine operating parameters leads away.

4. A fuel injection pump as defined by claim 3, in which said control grooves (32) can be made to communicate, upon the pumping stroke of the feed piston (14), with at least one fill bore (31) discharging from the pump interior (28) into the distributor cylinder (33).

5. A fuel injection pump as defined by claim 4, in which said control valve (30) is a check valve that opens in the direction of the pump interior (28).

6. A fuel injection pump as defined by claim 2, in which at least one of the control grooves (32) at a time establishes communication, during the intake stroke of the pump piston (17), between the annular groove (37)

and a return line (49), in which a pressure limiting valve (43) opening in the direction of the return line (49) is accommodated.

7. A fuel injection pump as defined by claim 3, in which at least one of the control grooves (32) at a time establishes communication, during the intake stroke of the pump piston (17), between the annular groove (37) and a return line (49), in which a pressure limiting valve (43) opening in the direction of the return line (49) is accommodated.

8. A fuel injection pump as defined by claim 4, in which at least one of the control grooves (32) at a time establishes communication, during the intake stroke of the pump piston (17), between the annular groove (37) and a return line (49), in which a pressure limiting valve (43) opening in the direction of the return line (49) is accommodated.

9. A fuel injection pump as defined by claim 5, in which at least one of the control grooves (32) at a time establishes communication, during the intake stroke of the pump piston (17), between the annular groove (37) and a return line (49), in which a pressure limiting valve (43) opening in the direction of the return line (49) is accommodated.

* * * * *